US006357687B1

(12) United States Patent
Liu

(10) Patent No.: US 6,357,687 B1
(45) Date of Patent: Mar. 19, 2002

(54) EASILY TEAR-OFF TISSUE HOLDER

(76) Inventor: I-Wen Liu, I Wen LIU P.O. Box 90, Tainan City (TW)

( * ) Notice: Subject to any disclaimer, the term of this patent is extended or adjusted under 35 U.S.C. 154(b) by 0 days.

(21) Appl. No.: 09/721,995

(22) Filed: Nov. 27, 2000

(51) Int. Cl.[7] ..... B65H 75/30
(52) U.S. Cl. ..... 242/422.4; 242/571.8; 225/106
(58) Field of Search ..... 242/422.4, 571.8, 242/574.4, 597.6, 597.7; 225/106

(56) References Cited

U.S. PATENT DOCUMENTS 1,762,516 A * 6/1930 Hlavac ..... 242/571.5
3,620,465 A * 11/1971 Wyatt ..... 242/422.5
3,770,221 A * 11/1973 Sternt ..... 242/422.4
3,980,250 A * 9/1976 Persson ..... 242/129.5
4,738,385 A * 4/1988 Bell ..... 225/106
5,135,179 A * 8/1992 Morano ..... 242/423.1
5,170,956 A * 12/1992 McTaggart ..... 242/422.4
5,938,141 A * 8/1999 Kanbar ..... 242/423.1
5,988,561 A * 11/1999 Mele ..... 242/599.1

FOREIGN PATENT DOCUMENTS

DE 36 13 988 A1 * 2/1986
GB 2 232 744 A * 12/1990

* cited by examiner

*Primary Examiner*—Donald P. Walsh
*Assistant Examiner*—Joseph Rodriguez

(57) ABSTRACT

An easily tear-off tissue holder includes a base, a shaft connected with and standing on the base, a fix rod connected with the shaft and having a slide hole for an upper small diameter connect rod of the shaft to fit and move up and down therein, and a press member connected on top of the fix rod to press down the fix rod and an elastic cylindrical member. When the press member is pressed down the fix rod and the elastic cylinder member, the elastic cylinder member with vertical slots and of narrow strips defined by every two neighboring vertical slots may elastically bend diametrically outward to push an inner wall of a cylindrical shaft of a coil tissue to stop the coil tissue immovable for easily tearing off a proper length of the tissue, by which the coil tissue may not be smeared in tearing off action.

9 Claims, 7 Drawing Sheets

EASILY TEAR-OFF TISSUE HOLDER

BACKGROUND OF THE INVENTION

1. Field of the Invention

This invention relates to an easily tear-off tissue holder, particularly to one having a press member to compress a coil spring and an elastic cylindrical member so that narrow strips formed around the wall of the elastic cylindrical member may elastically bend diametrically outward to push against an inner wall of a wind shaft of a coil tissue to stop the coil tissue immovable for a user to easily tear off a proper length of the tissue. Consequently the tissue holder is easy to handle, with the coil tissue kept clean and dry, very hygienic.

2. Description of the Prior Art

A known conventional tissue (or napkin or plastic tape) holder shown in FIG. 1 includes a tissue holder 91 connected with a fix base 92 installed on a wall, and a coil tissue 90 is placed around the tissue holder 90. In using, the outer end of the coil tissue is pulled out for a proper length, and a user holds two sides of the tissue to tear off. But the hands of a user may be wet or not clean to smear the rest of the coil tissue. Or the tissue holder 91 does not keep the coil tissue immovable to tear off a proper length of the tissue, often wasting the tissue.

SUMMARY OF THE INVENTION

The objective of the invention is to offer an easily tear-off tissue holder simple to handle in tearing off a proper length of the tissue for use, keeping the coil tissue clean.

The feature of the invention is an elastic cylindrical member located on an upper end of a shaft threadably connected vertically on a base, and a fix rod combined with an upper end of the elastic cylindrical member. Then a compress member fixed on the fix rod is compressed to push down the fix rod and then the elastic cylindrical member having a plurality of vertical slots and narrow strips formed between every neighboring two vertical slots may bend diametrically outward to push against an inner wall of a hollow wind shaft of a coil tissue. The coil tissue may be stopped immovable for a user to tear off tissue easily after a proper length of the coil tissue is pulled out . . .

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
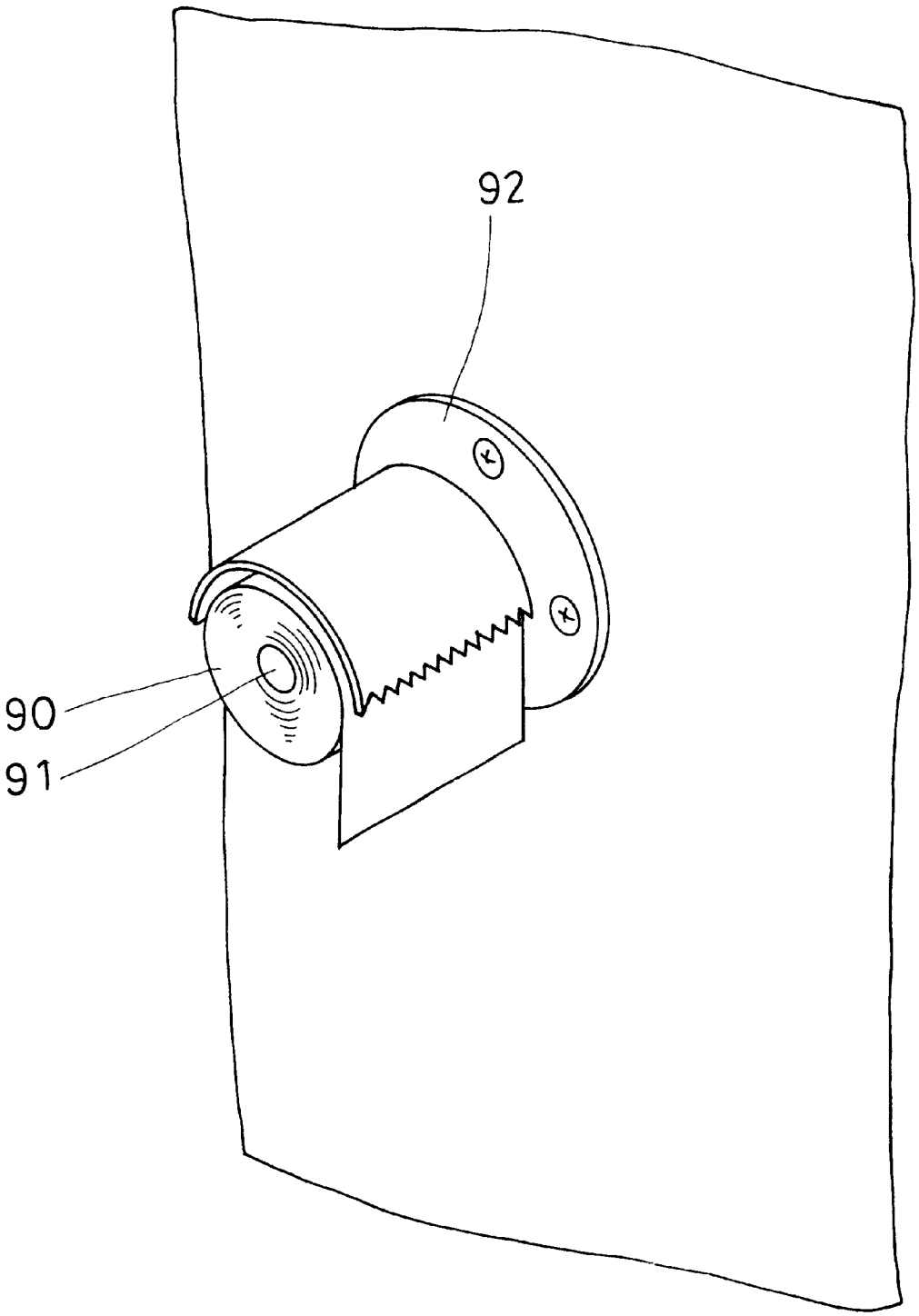
FIG. 1 (PRIOR ART)
FIG. 1 is a perspective view of a known conventional tissue holder fixed on a wall.
Figure 2:
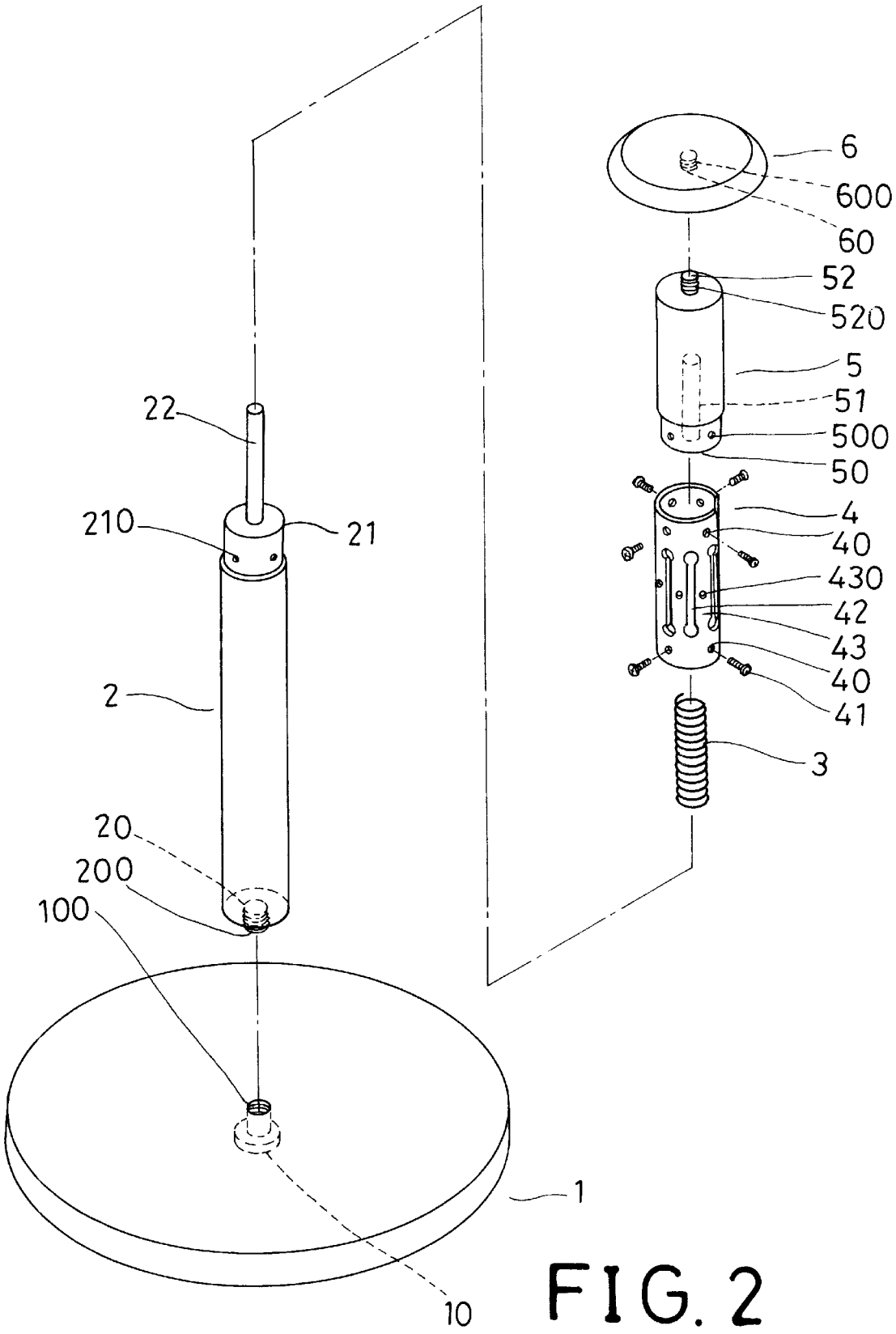
FIG. 2 is an exploded perspective view of an easily cut tissue holder in the present invention.

A first embodiment of an easily cut tissue holder in the present invention, as shown in FIG. 2, includes a base 1, a shaft 2, a coil spring 3, an elastic cylindrical member 4, a fix rod 5, and a press member 6 as main components combined together.

The base 1 is disc-shaped, having a connector 10 fixed in an upper center provided with female threads 100.

The shaft 2 is vertically combined with and on the base 1, having a connect end 20 formed in a lower end to combine with the connector 10 of the base 1 by means of male threads 200 to engage with the female threads 100, a connect section 21 formed in an upper portion, plural screw holes formed spaced apart around the connect section 21, and a small diameter connect rod 22 extending up from the connect section 21.

The coil spring 3 fits around the small diameter connect rod 21 of the shaft 2.

The elastic cylindrical member 4 connects with the connect section 21 of the shaft 2, having a plurality of screw holes spaced apart around a lower end and in an upper end for screws 41 to engage in, a plurality of vertical slots 42 spaced apart equidistantly in its wall, a narrow strip 43 defined by every neighboring two of the vertical slots 42 and bored with a hole 430 for easy bending. The holes 430 in the narrow strips 43 are arranged in a same level so that the narrow strips 43 may quickly bend outward diametrically in a same line to function well to stop an inner wall of a cylindrical shaft of a coil tissue held on the tissue holder.

The fix rod 5 has a connect section 50 formed in a lower end and provided with plural screw holes 500 spaced apart for screws 41 to screw through after the connect section 50 is fitted in an upper inner end of the elastic cylindrical member 4, with the screws 41 also screwing in the screw holes 40 of the cylindrical member 4. The fix rod 5 further has a center slide hole 51 formed in a lower portion for the connect rod 22 of the shaft 2 to fit therein. As some space is still remained between an upper end of the slide hole 51 and the upper end of the connect rod 22, the fit rod 5 can be compressed to move down with the slide hole sliding along the connect rod 22 when the elastic cylindrical member 4 is bent by compressing the press member 6. Thus the space in the slide hole 51 can permit the narrow strips 43 of the elastic cylindrical member 4 to bend diametrically outward to enlarge the diameter of the bent points of the elastic cylindrical member 4. In addition, the elastic cylindrical member 4 can be put off its service life. Further the fix rod 5 has an upper connect end 52 provided with male threads 520.

The press member 6 is disc-shaped, having a center connect section 60 with female threads 600 to engage the male threads 520.

Figure 3:
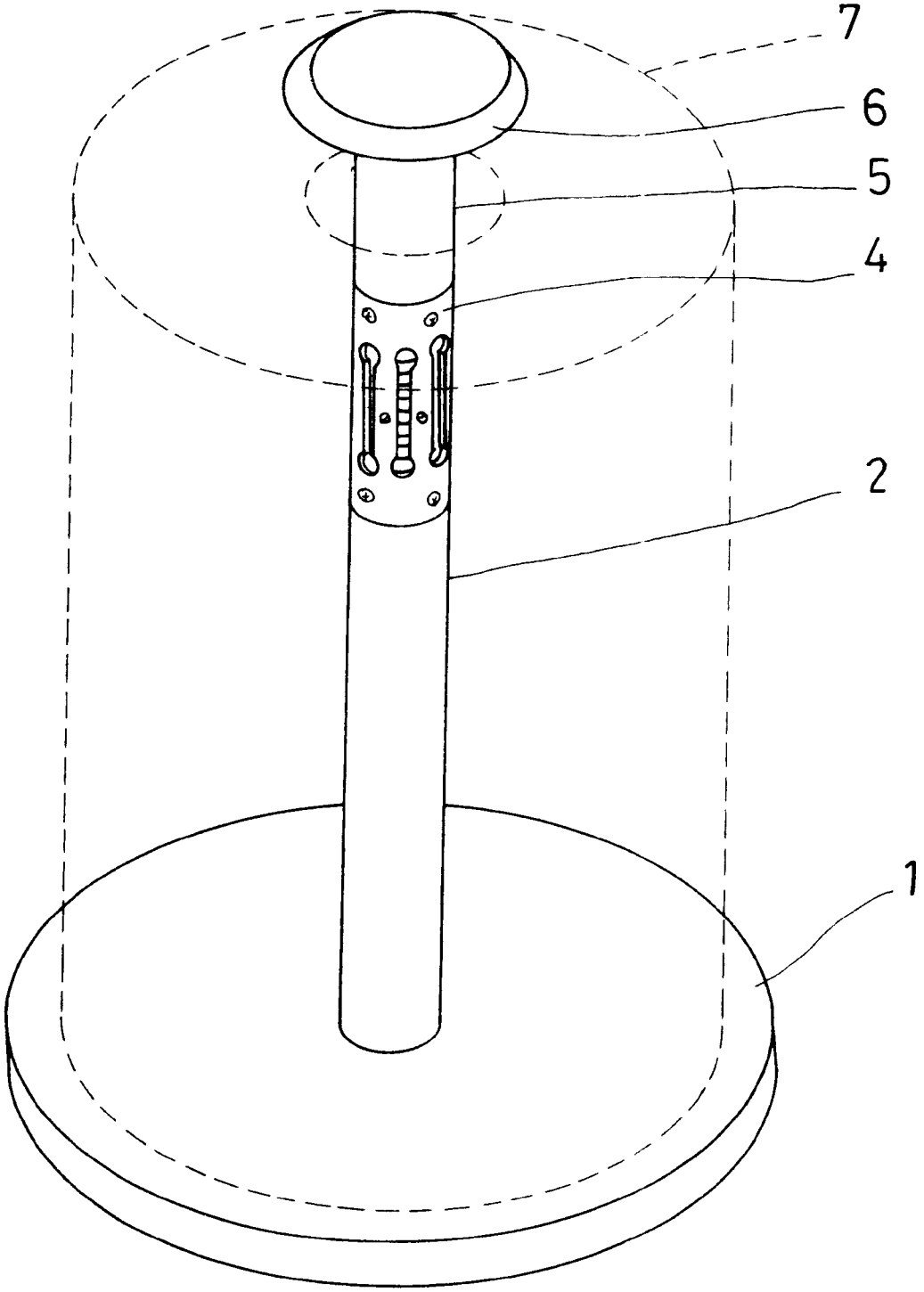
FIG. 3 is a perspective view of the easily cut tissue holder in the present invention.

In assembling, referring to FIGS. 2 and 3, firstly the lower male threaded end 20 of the shaft 2 is engaged with the connector 10 of the base 1. Next, the coil spring 3 is fitted around the connect rod 22 of the shaft 2, and the lower end of the elastic cylindrical member 4 is fitted around the connect section 21 with the screws holes 40 aligned to the screw holes 20 of the shaft 2 for the screws 41 to screw therein to combine the elastic cylindrical member 4 with the shaft 2. After that, the fix rod 5 have its slide hole 50 aligned and fitted with the connect rod 22, letting the lower end of the hole 50 extending in an upper end of the elastic cylindrical member 4, with the screw holes 500 and 40 aligned to each other for screws 41 screwing therein. Lastly, the press member 6 is combined with the fix rod 5, with the connect hole 60 screwed with the upper connect end 52 of the fix rod 5, finishing assembly of the easily cut tissue holder in the invention.

Figure 4:
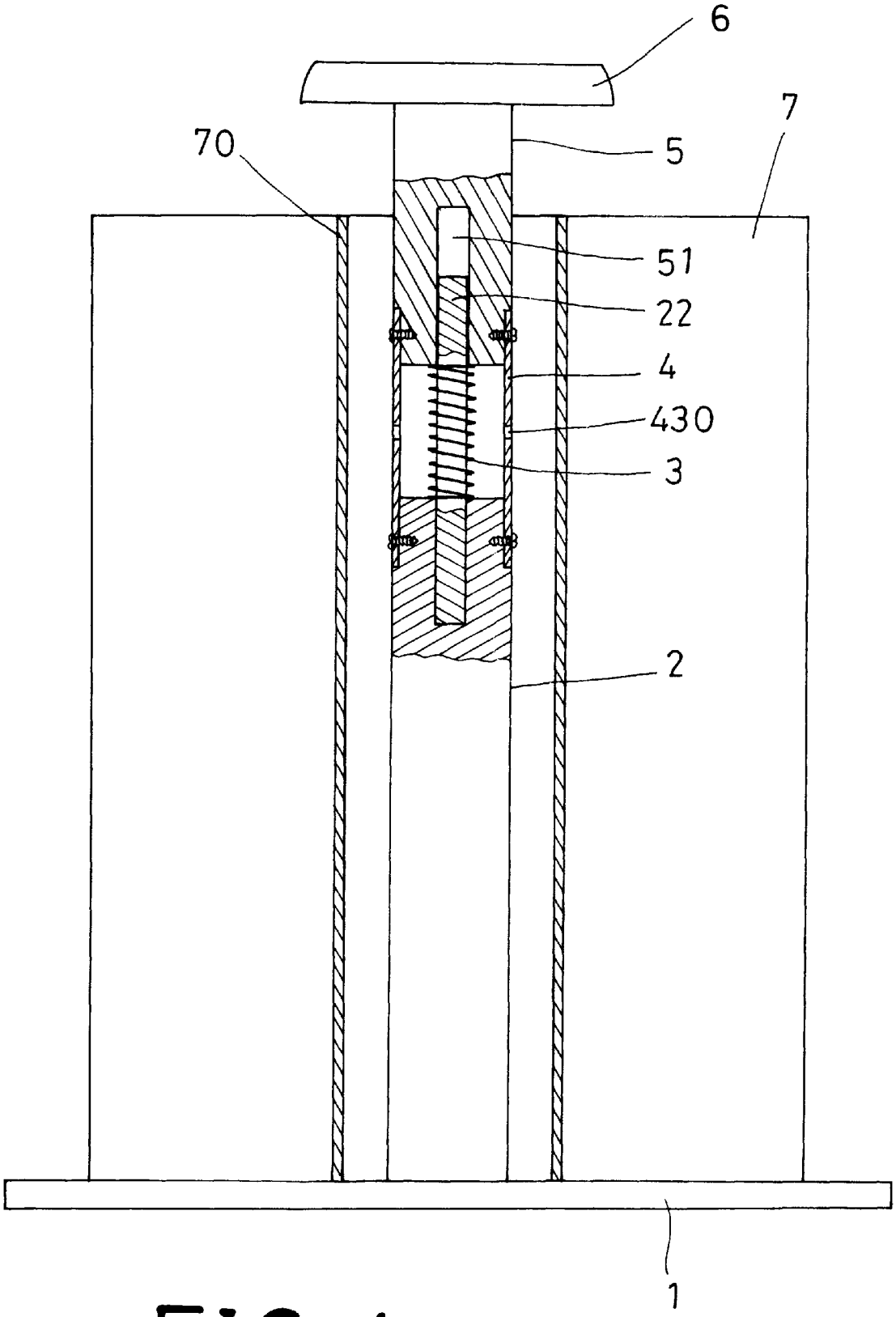
FIG. 4 is a cross-sectional view of the easily cut tissue holder with a coil tissue placed on it in the present invention.
Figure 5:
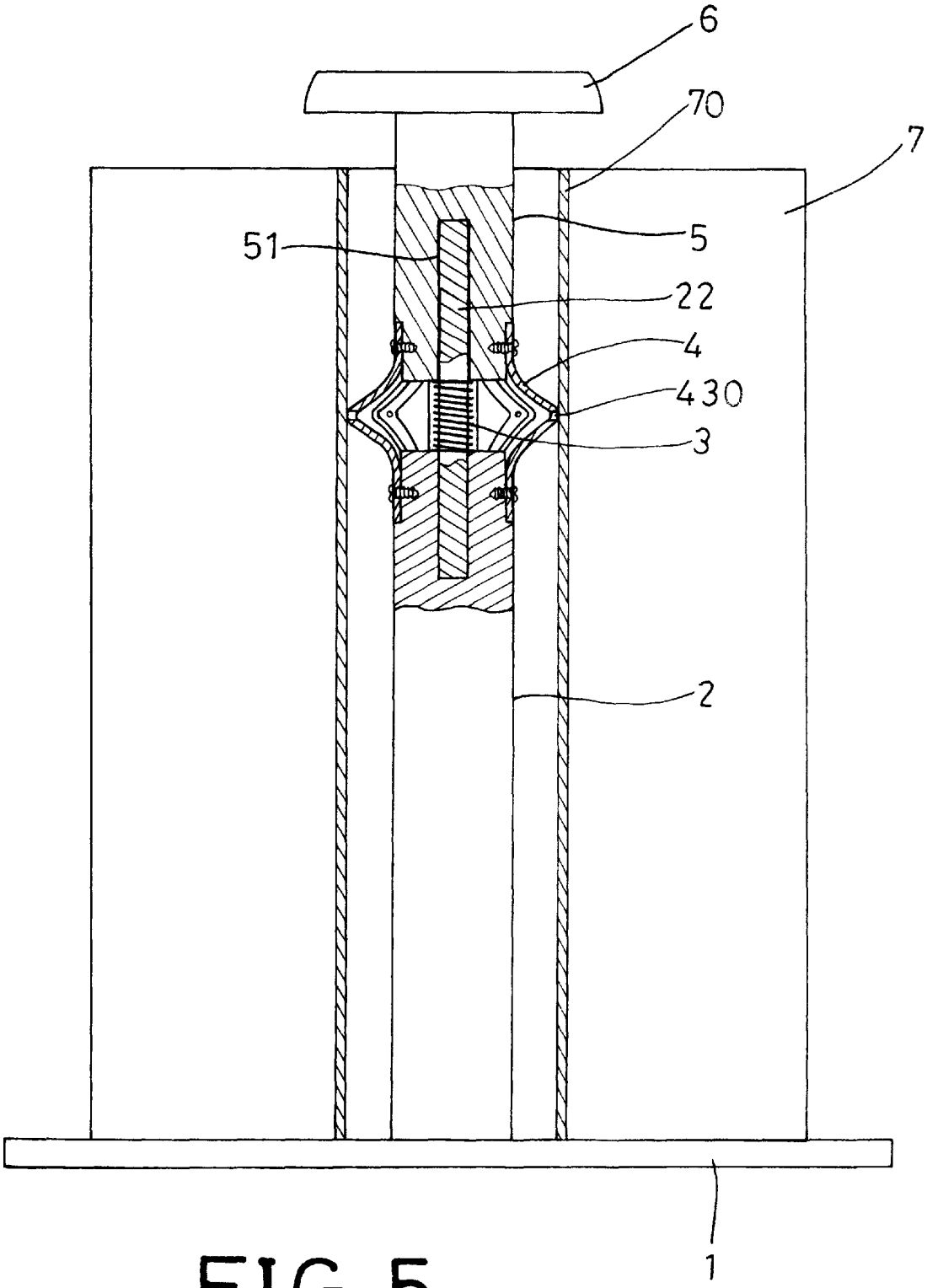
FIG. 5 is a cross-sectional view of the easily cut tissue holder under using condition in the present invention.

In using the easily tear-off tissue holder, as shown in FIGS. 2, 4 and 5, only press down and remove the press member 6 from the fix rod 5, and then place a coil tissue 7 (or a coil napkin or a plastic tape) down, with a cylindrical wind shaft 70 of the coil tissue 7 fitting around the shaft and the fix rod 5 and with the elastic cylindrical member 4 located within the wind shaft 70. Then the press member 6 is screwed on the fix rod 5 again, and should have a larger diameter than that of the wind shaft 70 of a coil tissue 7 to prevent the same tissue 7 from falling off. When the tissue is to be used, only press down the press member 6, forcing the fix rod 5 slide down by means of the slide hole 51 moving down along the connect rod 22 of the shaft 2, with the coil spring 3 compressed at the same time. Then the narrow strips 43 may be pressed to bend diametrically outward to push against the inner wall of the wind shaft 70 of the coil tissue 7, which is then kept immovable. As the narrow strips 43 have holes 430 are located on the same level, permitting the narrow strips 43 to bend quickly at a horizontal line to stop the coil tissue 7 so that a proper length of tissue may be tom off for use. Then the press member 6 may be released to recover its position, letting the coil spring 3 and the elastic cylindrical member 4 recover their resilience to handle the easily cut tissue holder.

Figure 6:
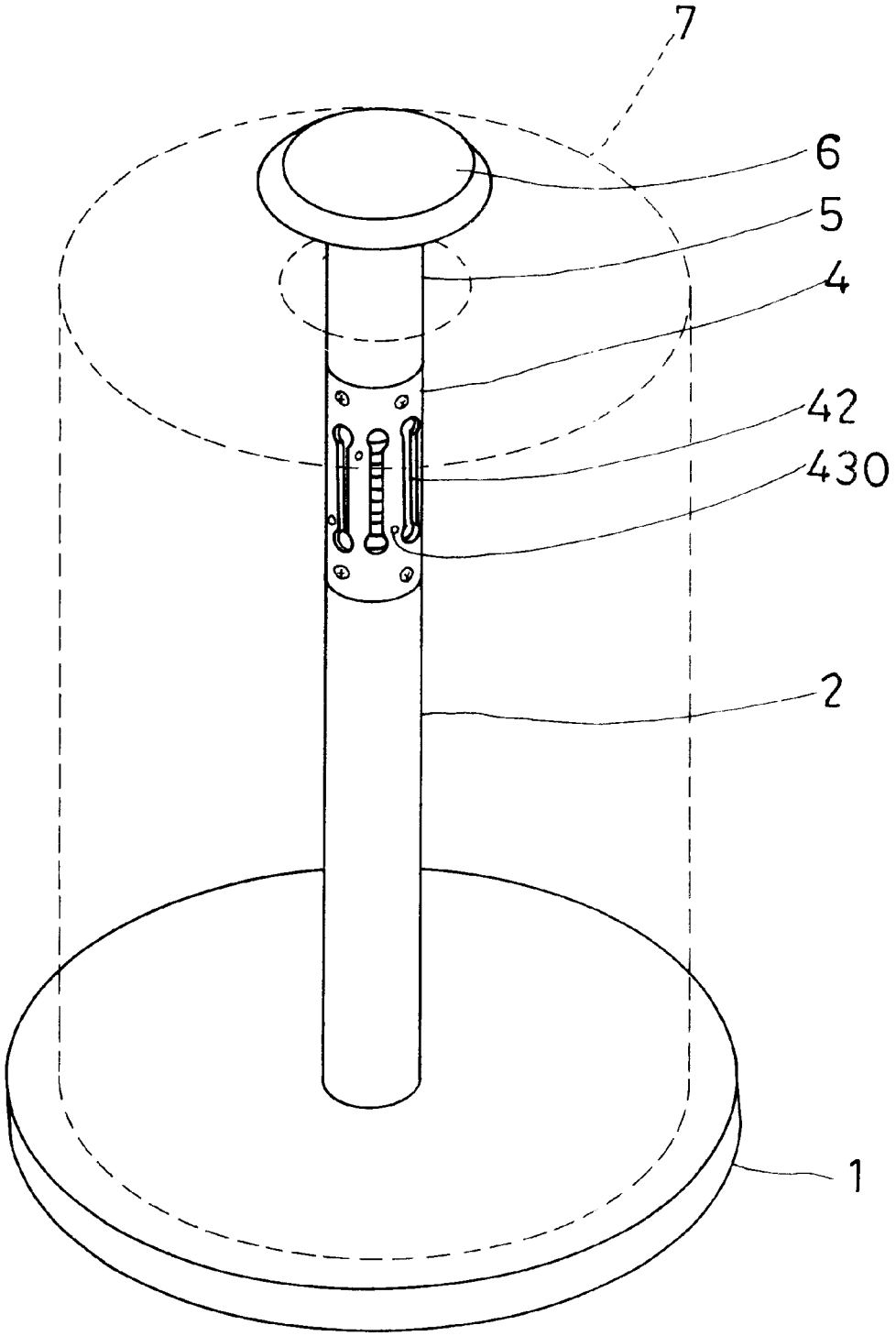
FIG. 6 is a cross-sectional view of a second embodiment of an easily cut tissue holder in the present invention; and, FIG. 7 a cross-sectional view of the second embodiment of an easily cut tissue holder with a coil tissue placed on fixed laterally on a wall in the present invention.
Figure 7:
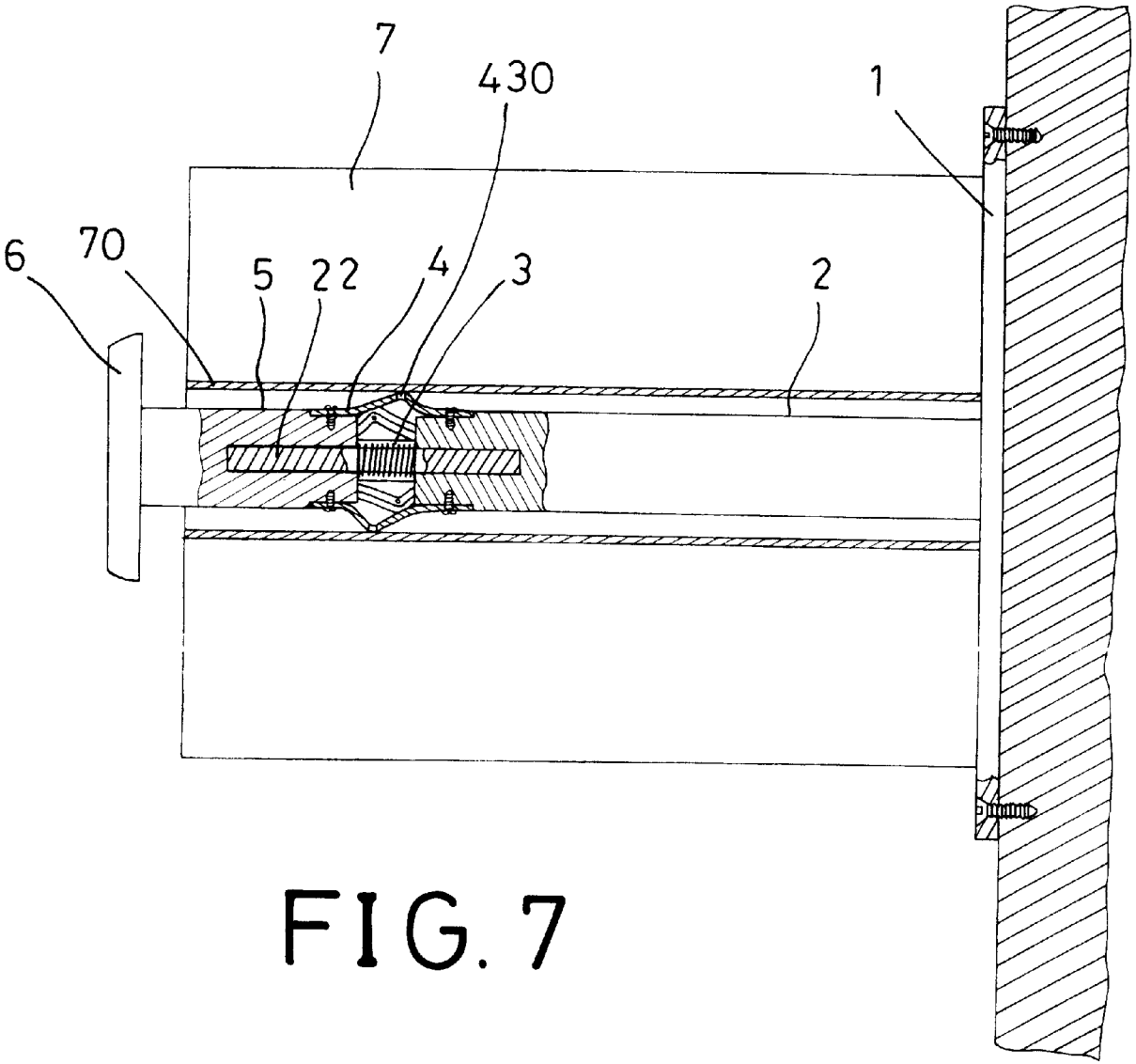

A second embodiment of a easily tear-off tissue holder in the invention is shown in FIGS. 2, 6 and 7, having almost the same components, except the elastic cylindrical member 4, which has a plurality of vertical long slots 42 spaced apart equidistantly, and a narrow strip 43 defined by every two neighboring slots 42 and provided with a hole 430 symmetrically located to crossing with each other to acquire effect of bending in double levels. Consequently, the narrow strips 43 may bend in double levels to increase stopping force against the inner wall of the wind shaft 70 of the coil tissue 7. In using, only press the press member 6 to compress the coil spring 3 and the elastic cylindrical member 4, forcing the narrow strips 43 to bend in double levels owing to the holes 430 with two lines of bent tops to push the inner wall of the wind shaft of the coil tissue 7 to stop the same tissue 7 for tearing easily the tissue off. After the press member 6 is released, the resilience of the coil spring 3 and the elastic cylindrical member 4 lets the fix rod 5 and the press member 6 recover its position. The easily tear-off tissue holder may be positioned on a table or fixed on a wall or the like, possible to be positioned in various ways, very convenient to use.

The invention has the following advantages, as can be understood from the aforesaid description.

1. The narrow strips of the elastic cylindrical member can bend outward to push against the inner wall of the wind shaft of a coil tissue to stop temporarily the coil tissue for easily tearing, off a proper length for use, convenient to handle.

2. It can be positioned on a table or a wall, easy to handle and use.

3. Its structure is simple, easy and quick to assemble, stable after assembled, cost-friendly and durable.

4. Tearing off a proper length of tissue is surely carried out by only pressing down the press member, convenient to handle, never wetting or smearing unused portion of a coil tissue, very hygienic.

While the preferred embodiments of the invention have been described above, it will be recognized and understood that various modifications may be made therein and the appended claims are intended to cover all such modifications that may fall within the spirit and scope of the invention.

What is claimed is:

1. An easily tear-off tissue holder comprising:

a base shaped as a disc and having a connector on an upper center;

a shaft having a lower connect end to connect with said connector of said base, an upper connect member formed in an upper portion, and a small diameter connect rod formed to extend up from the upper connect member;

an elastic cylindrical member having a lower end fixed firmly with said upper connect member of said shaft, a plurality of vertical long slots spaced apart equidistantly in its wall, a narrow strip defined by every two of said vertical long slots;

a fix rod having a lower end fittingly fixed in an upper end of said elastic cylindrical member, a center slide hole with an open lower end and a closed upper end, and an upper small diameter connect end;

a press member shaped as a disc, having a center-threaded hole to engage with said upper small diameter connect end of said fix rod; and, said press member pressed down to force said narrow strips of said elastic cylindrical member to bend diametrically outward to push against an inner wall of a cylindrical wind shaft of a coil tissue to stop immovable said coil tissue so as to tear off a proper length of tissue pulled out for use after said coil tissue is placed around said fix rod and said shaft.

2. The easily tear-off tissue holder as claimed in claim 1, wherein a coil spring is further fitted around said upper connect rod of said shaft, resiliently pushing back said fix rod and said elastic cylindrical member to their original positions after said press member is released after pressed down.

3. The easily tear-off tissue holder as claimed in claim 1, wherein said plural narrow strips of said elastic cylindrical member respectively have a hole for bending, said holes for bending being located horizontally on a same level, permitting said narrow strips easily bent outward on the same level against an inner wall of a wind shaft of a coil tissue to stop immovable said coil tissue.

4. The easily tear-off tissue holder as claimed in claim 1, wherein said narrow strips respectively have a hole for bending located at symmetrically diagonal positions, in order to form double bending levels to push against said inner wall of said wind shaft of a coil tissue to increase pushing force to more effectively stop said coil tissue immovable.

5. The easily tear-off tissue holder as claimed in claim 1, wherein two ends of said elastic cylindrical member are respectively connected with said shaft and said fix rod by means of threading.

6. The easily tear-off tissue holder as claimed in claim 1, wherein said slide hole of said fix rod has a preset upper hollow space for said upper connect rod of said shaft to move up and down in said slide hole so that said elastic cylindrical member may bend diametrically outward and increase its service life.

7. The easily tear-off tissue holder as claimed in claim 1, wherein said press member has a larger diameter than that of a wind shaft of a coil tissue to prevent said coil tissue from falling off said fix rod and said shaft.

8. The easily tear-off tissue holder as claimed in claim 1, wherein said a lower end of said shaft is engaged with said connect member of said base by means of screwing, and said base is fixed on a wall with screws.

9. The easily tear-off tissue holder as claimed in claim 1, wherein an upper end of said fix rod is connected with said press member by means of threads.

* * * * *